US006755282B1

(12) United States Patent
Herold

(10) Patent No.: US 6,755,282 B1
(45) Date of Patent: Jun. 29, 2004

(54) SAW HORSE

(76) Inventor: Christopher Neal Herold, 34504 Main St. NE., Cambridge, MN (US) 55008

( * ) Notice: Subject to any disclaimer, the term of this patent is extended or adjusted under 35 U.S.C. 154(b) by 0 days.

(21) Appl. No.: 09/626,468

(22) Filed: Jul. 26, 2000

(51) Int. Cl.[7] ..... E04G 1/00

(52) U.S. Cl. ..... 182/186.5; 182/181.1; 182/186.3

(58) Field of Search ..... 182/181.1, 185, 182/186.3, 186.5, 178.5, 178.6, 153, 224, 225, 226

(56) References Cited

U.S. PATENT DOCUMENTS

| | | | | | |
|---|---|---|---|---|---|
| 501,348 | A | * | 7/1893 | Jaquess | 182/186.5 X |
| 555,269 | A | * | 2/1896 | Sprague | 182/186.5 X |
| 604,979 | A | * | 5/1898 | Garrett | 182/186.5 X |
| 936,945 | A | * | 10/1909 | Rice | 182/186.5 X |
| 2,816,805 | A | * | 12/1957 | Vaughn | 182/186.5 X |
| 2,829,927 | A | * | 4/1958 | Sword | 182/186.5 X |
| 3,212,606 | A | * | 10/1965 | Spaw | 182/186.5 X |
| 3,406,786 | A | * | 10/1968 | Lang | 182/186.5 X |
| 4,192,406 | A | * | 3/1980 | Mitchell | 182/185 |
| 4,457,399 | A | * | 7/1984 | Breisch | 182/185 |
| 4,496,028 | A | * | 1/1985 | Peterson | 182/186 |
| 4,911,390 | A | * | 3/1990 | Flick | 248/168 |
| 4,943,035 | A | * | 7/1990 | Thomson | 256/64 |
| 5,141,077 | A | * | 8/1992 | Zuercher | 182/185 |
| 5,318,150 | A | * | 6/1994 | Donaho | 182/181 |
| 5,484,037 | A | * | 1/1996 | Neumarkel | 182/185 |
| 5,779,003 | A | * | 7/1998 | Carty | 182/225 |
| 5,913,381 | A | * | 6/1999 | D'Arrmond, Jr. | 182/186.3 |
| 5,921,347 | A | * | 7/1999 | Rodriguez et al. | 182/186.2 |
| 6,059,071 | A | * | 5/2000 | Appezzato | 182/181.1 |
| 6,145,269 | A | * | 11/2000 | Fisher | 52/726.2 |
| 6,155,318 | A | * | 12/2000 | Underwood | 144/286.1 |

* cited by examiner

*Primary Examiner*—Bruce A. Lev
(74) *Attorney, Agent, or Firm*—Norman P Friederichs; N Paul Friederichs

(57) ABSTRACT

A materials support including a pair of leg supports and a horizontal support, the leg supports including a tubular member adapted to snugly receive a portion of said horizontal support and a pair of laterally extending legs, the legs being integral with the tubular member.

19 Claims, 3 Drawing Sheets

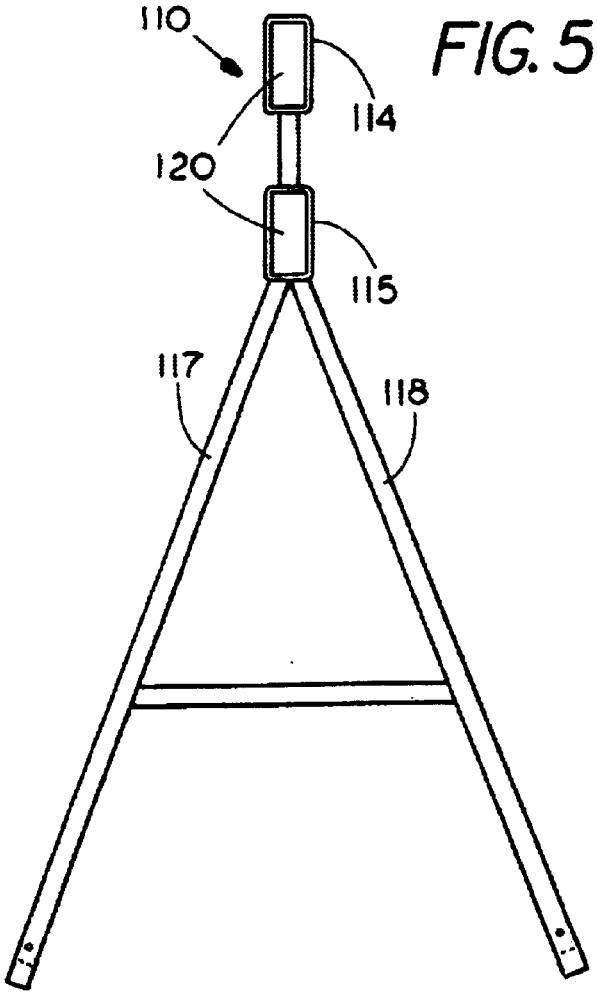
FIG. 5
FIG. 6
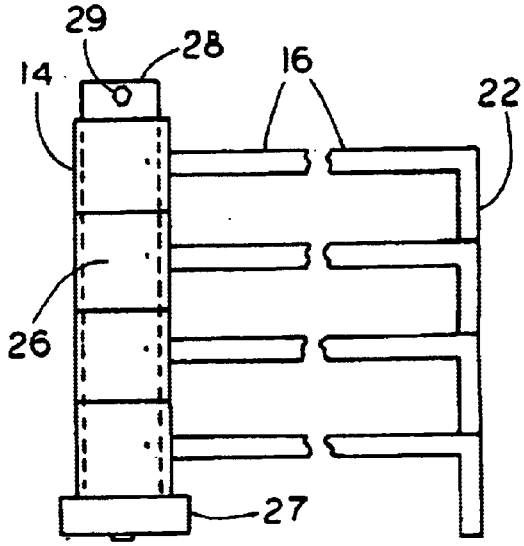

SAW HORSE

FIELD OF THE INVENTION

The present invention relates to supports and more particularly to supports of the type commonly referred to a saw horse.

BACKGROUND OF THE INVENTION

Material supports have been used for many years in conjunction with construction work. Material supports have been used as platforms on which wooden boards are placed while they are sawed, planed, painted and the like. One type of material support used at construction sites is referred to as saw horses. This type of support generally includes a pair of leg supports disposed at each end of a horizontal support. In the past reusable saw horses have been bulky and difficult to transport from one job site to another. For this reason saw horses have often been constructed on the site and destroyed after the construction is completed.

There has long been a need for a portable, collapsible saw horse. There have been many unsuccessful attempts in the past to provide a suitable portable collapsible saw horse. Prior collapsible saw horses have been complex, lacking in strength and often difficult to put up and take down.

The present invention provides a very simple collapsible saw horse that is compact when disassembled. The present saw horse is strong and sturdy in use. The present saw horse is so durable that it can be used for many years in at a series of industrial construction sites.

The present saw horse may be used on construction work in the same manner as prior saw horses. The saw horse of the present invention also may be used as a barricade such as are used on streets, highways and parking lots.

SUMMARY OF THE PRESENT INVENTION

The present invention may be constructed of metal. The present material support device, e.g., saw horse, includes a pair of leg supports that may be easily attached and detached from a horizontal support member, e.g., a timber such as a 2×4, without nails, screws or any fastener. The present saw horse leg supports include a tubular upper member which is integral with a pair of downwardly and laterally extending legs.

The tubular upper member may be of any desired shape in conformation with the shape of the horizontal support member, e.g., rectangular in shape for use with 2×4s. The opening of the tube faces in a direction aligned with the horizontal support which is perpendicular to the plane that extends from one leg to the other leg. The tubular member has an opening that snugly receives the horizontal member such as a piece of timber, i.e., construction lumber such as a 2×4, a 2×6 or a 4×4.

The tubular member has sufficient length that the timber is snugly held and thereby providing stability such that the leg support is prevented from pivoting with respect to the timber. Typically the tubular member may be two or three inches in axial length. The wall thickness of the tubular member is sufficient to provide the necessary strength during use on the construction site. Typically the thickness of walls of the tubular member will be 1/16th inch to 3/8th inch. The tubular member may be cut from conventional tubular stock, such as rectangular tube stock. In some instances more than one tubular member may be provided in a vertical arrangement on each support leg, for example to serve as a barricade.

The horizontal member may be of any desired cross sectional shape such as rectangular. It is desirable that the horizontal member is construction lumber such as 2×4s or 2×6s.

IN THE DRAWINGS

FIG. 5 shows a plan view of an alternative embodiment of the present invention including two tubular members.

FIG. 6 shows a plan view of a plurality of leg supports held together with a stacking mechanism for transportation

DETAILED DESCRIPTION OF THE PRESENT INVENTION

Figure 1:
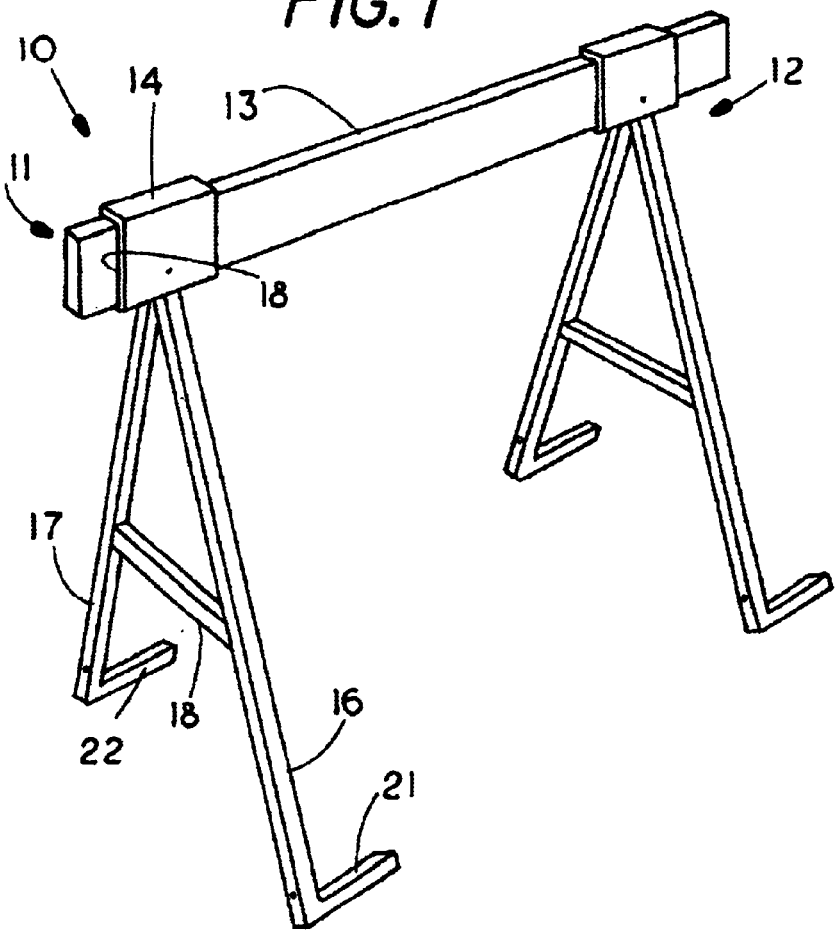
FIG. 1 shows a perspective view of the saw horse of the present invention.
Figure 2:
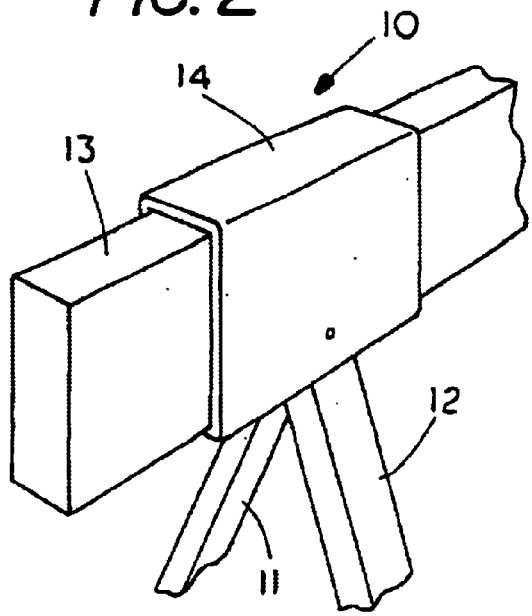
FIG. 2 shows a portion of the saw horse leg support of the present invention in an exploded view.
Figure 3:
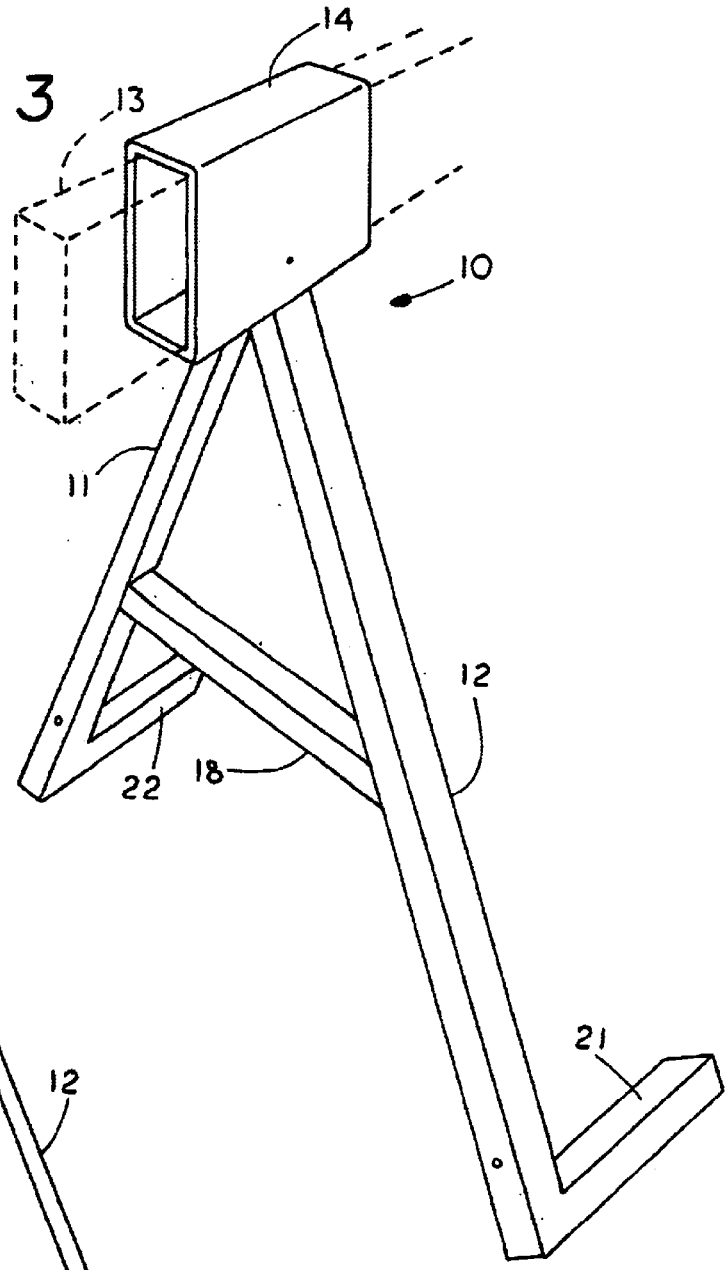
FIG. 3 shows an enlarged view of the upper portion of one of the legs of the present saw horse.
Figure 4:
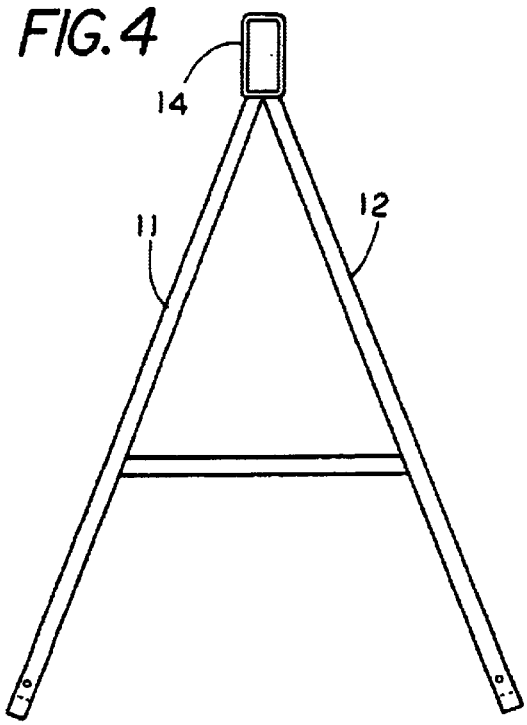
FIG. 4 shows a vertical plan view of the leg of the present invention.

The saw horse 10 of the present invention (FIGS. 1–5) includes a pair of leg supports 11 and 12 that support a horizontal member 13. The leg supports 11 and 12 may be identical in construction and therefore only leg 11 will be described in detail. Leg support 11 includes an upper tubular member 14 and a pair of laterally and downwardly extending legs 16 and 17. Any desired angle may be provided between the legs, for example 20 to 40 degrees. The tubular member 14 may be formed by casting of metal or plastic. Alternatively, the tubular member 14 may be cut from tubular stock. The tubular member 14 defines an opening 15 that is sized to snugly receive the horizontal member 13. The tubular member 14 is of sufficient length l to provide stability of the leg support 11 and 12 with respect to the horizontal member 13.

The legs 16 and 17 may be any suitable stock. For example, square tube stock may be used. The square stock may for example be ¾ inch to 1 inch on a side. Alternatively, angle iron or circular tubular stock may be used. The legs 16 and 17 may be of any suitable length to provide the proper elevation of the upper edge, e.g., working surface of the material support. The legs 16 and 17 may be secured to the tubular member 14 by any suitable mechanism, such as welding. If desired the legs 16 and 17 may be telescoping legs to permit adjustment of the height of the working surface. The legs 16 and 17 may include a brace 18. The legs 16 and 17 may include a foot 21 and 22 respectively. The feet 21 and 22 serve to broaden the surface in contact with the ground surface for use in soft soil such as sand. Feet 21 and 22 also serve to space the lower ends of the legs 16 and 17 when in a stacked position as shown in FIG. 6.

The horizontal member 13 desirably is dimension lumber of the type commonly found at the construction site. Typically, 2×4s may be used. If desired, the horizontal member 14 may be tubular metal stock such as two inch water pipe, however, the tubular member must conform to the size and shape of the alternate horizontal member A stacking mechanism 26 (FIG. 6) may be provided to retain the leg supports 10 as a unit when in transportation from one job site to another. The stacking mechanism 26 may include a base 27 that is larger than to opening defined in the tubular member 14 thereby preventing the leg supports from sliding over the lower end of the mechanism 26. The mechanism 26 may include a vertical member 28 over which the tubular portions 14 may be mounted. The vertical member 28 desirably has the size and shape to snugly fit into the tubular portions 14, e.g., a 2×4. The upper portion of the mechanism 26 may include a lock structure 29 such as a key to prevent the leg supports 10 from separating over the upper ends of the mechanism 26 during transportation from job site to job site. The lock structure 29 may, for example, simply be a bolt including a nut.

ALTERNATIVE EMBODIMENT

An alternative embodiment support member 110 of the present invention is shown in FIG. 5. The support member 110 is suitable for use as a barricade support such as may be used to prevent egress onto a road under construction. The support member 110 may be constructed of metal and includes an upper or first tubular member 114 and a lower or second tubular member 115 interconnected by vertical member 120. A pair of legs 117 and 118 are integral with the lower tubular member 115. The tubular members 114 and 115 may each include an opening suitable for receipt of a 2×4 timber. The legs 117 and 118 are spread sufficient to provide side to side stability when in use. A pair of support members 110 serve to support a pair of 2×4 timbers when in use and act as a barricade.

What is claimed is:

1. A materials support comprising:

a pair of leg supports, each said leg support comprising a rectangular member and a pair of laterally extending legs, said rectangular member being tubular, said legs being integral with said rectangular members, and a horizontal support being rectangular in cross section and sized to be snugly but slidably received in said rectangular members, said snug and slidable reception of said horizontal support in said rectangular members being the sole attachment between said leg supports and said horizontal support, said horizontal support further including a first end and a second end, one of said leg supports being disposed inwardly from each end of said horizontal support and;

a storage alignment keeper that extends through each said rectangular member.

2. The materials support of claim 1 wherein said rectangler members are of sufficient length to provide vertical stability to said legs with respect to said horizontal support.

3. The materials support of claim 1 wherein said leg supports are constructed of metal.

4. The materials support of claim 1 wherein said horizontal support is a 2×4 timber.

5. The materials support of claim 1 wherein said horizontal support is a wood member having a rectangular cross section.

6. The materials support of claim 1 wherein said rectangular member has a length of at least two inches.

7. The materials support of claim 1 wherein said rectangular member has a length of between two and three inches.

8. The materials support of claim 1 wherein said legs each include a foot.

9. A materials support, comprising:

a horizontal support:

a plurality of leg supports, each leg support including a rectangular tubular member and a pair of laterally extending legs, said rectangular tubular member adapted to slidably and snugly receive a portion of said horizontal support, said slidable and snug reception of said horizontal support in said rectangular tubular members being the sole attachment between said leg supports and said horizontal support, said rectangular tubular members being integral with said legs and said leg supports capable of being vertically stacked for storage; and a storage alignment keeper that extends through each said rectangular tubular members.

10. The materials support of claim 9 wherein said legs each include a foot, and wherein said foot of each said leg of said leg supports are structured to interact with the next adjacent leg support to maintain said legs in parallel alignment during storage.

11. The materials support of claim 9 wherein said storage alignment keeper includes means for retaining said leg supports on said keeper.

12. A saw horse comprising:

horizontal support;

a pair of leg supports, each of said leg supports including a tubular member adapted to snugly receive a portion of said horizontal support and a pair of laterally extending legs, said legs of each leg support being integral with said tubular member, said legs being disposed at an angle of between 20 and 40 degrees with respect to each other, said tubular members being of sufficient length to provide vertical stability of said leg supports with respect to said horizontal support; and a storage alignment keeper that extends through each said tubular members.

13. The saw horse of claim 12 wherein said leg supports are constructed of metal.

14. The saw horse of claim 12 wherein said horizontal support is a 2×4 timber.

15. The saw horse of claim 12 wherein said tubular members have a length of between two and three inches.

16. The saw horse of claim 12 wherein said horizontal support is a wood member having a rectangular cross section.

17. The saw horse of claim 12 wherein said tubular members are rectangular and have a length of at least two inches.

18. The saw horse of claim 12 wherein said legs each include a foot.

19. The saw horse of claim 12 wherein said snug reception of said horizontal support in said tubular members are the sole attachments between said leg supports and said horizontal support.

* * * * *